United States Patent [19]

Griner

[11] Patent Number: 4,936,435

[45] Date of Patent: Jun. 26, 1990

[54] COIN VALIDATING APPARATUS AND METHOD

[75] Inventor: Paul K. Griner, St. Louis, Mo.

[73] Assignee: UniDynamics Corporation, New York, N.Y.

[21] Appl. No.: 255,772

[22] Filed: Oct. 11, 1988

[51] Int. Cl.[5] ..... G07D 5/08

[52] U.S. Cl. ..... 194/317; 209/556

[58] Field of Search ..... 194/317, 318, 319; 209/555, 556, 570

[56] References Cited

U.S. PATENT DOCUMENTS

| | | | |
|---|---|---|---|
| Re. 28,827 | 5/1976 | Fougere . | |
| Re. 29,090 | 12/1976 | Fougere . | |
| 1,964,966 | 7/1934 | Troy . | |
| 2,690,258 | 9/1954 | Cox | 209/111 |
| 2,982,389 | 5/1961 | Dietrich . | |
| 2,985,844 | 5/1961 | Wesch | 331/66 |
| 3,059,749 | 10/1962 | Zinke . | |
| 3,152,677 | 10/1964 | Phillips . | |
| 3,169,626 | 2/1965 | Miyagawa . | |
| 3,317,016 | 5/1967 | Turillon . | |
| 3,373,856 | 3/1968 | Kusters et al. . | |
| 3,401,780 | 9/1968 | Jullien-Davin . | |
| 3,453,532 | 7/1969 | Gardiner | 324/3 |
| 3,467,855 | 9/1969 | Rance | 324/3 |
| 3,481,443 | 12/1969 | Meloni . | |
| 3,506,103 | 4/1970 | Kuckens et al. . | |
| 3,531,625 | 9/1970 | Mizuta et al. | 235/61.7 |
| 3,561,580 | 2/1971 | Meloni . | |
| 3,576,244 | 4/1971 | Ptacek et al. . | |
| 3,587,809 | 6/1971 | Meloni . | |
| 3,596,744 | 8/1971 | Chesnokov et al. . | |
| 3,599,771 | 8/1971 | Hinterstocker . | |
| 3,653,481 | 4/1972 | Boxall et al. . | |
| 3,682,286 | 8/1972 | Prumm . | |
| 3,738,468 | 6/1973 | Prumm . | |
| 3,738,469 | 6/1973 | Prumm . | |
| 3,739,895 | 6/1973 | Fougere et al. . | |
| 3,741,363 | 6/1973 | Hinterstocker . | |
| 3,749,220 | 7/1973 | Tablichi et al. . | |
| 3,796,295 | 3/1974 | Montolivo et al. . | |
| 3,797,307 | 3/1974 | Johnston | 73/163 |
| 3,797,628 | 3/1974 | Fougere et al. . | |
| 3,869,663 | 3/1975 | Tschierse | 324/41 |
| 3,870,137 | 3/1975 | Fougere | 194/100 |
| 3,901,368 | 8/1975 | Klinger . | |
| 3,916,922 | 11/1975 | Prumm . | |
| 3,918,563 | 11/1975 | Schwippert et al. . | |
| 3,918,564 | 11/1975 | Heiman et al. . | |
| 3,918,565 | 11/1975 | Fougere et al. . | |
| 3,921,003 | 11/1975 | Greene | 250/557 |
| 3,933,232 | 1/1976 | Searle et al. . | |
| 3,939,953 | 2/1976 | Miyazawa . | |
| 3,952,851 | 4/1976 | Fougere et al. . | |
| 3,962,627 | 6/1976 | Ptacek et al. | 324/34 |

(List continued on next page.)

FOREIGN PATENT DOCUMENTS

| | | |
|---|---|---|
| 1474903 | 9/1969 | Fed. Rep. of Germany . |
| 2015131 | 8/1970 | Fed. Rep. of Germany . |
| 1774568 | 2/1972 | Fed. Rep. of Germany . |
| 2159599 | 6/1972 | Fed. Rep. of Germany . |
| 1375554 | 11/1971 | United Kingdom . |

*Primary Examiner*—F. J. Bartuska

*Attorney, Agent, or Firm*—Senniger, Powers, Leavitt and Roedel

[57] ABSTRACT

Apparatus and method for evaluating a conductive coin to verify its authenticity and to determine its denomination. A first oscillator circuit generates a first oscillating signal for energizing a first coil producing a first magnetic field. The first oscillating signal has a first parameter which is a function of disturbances in the first magnetic field when the coin to be evaluated is located within the first magnetic field. A second oscillator circuit generates a second oscillating signal for energizing a second coil producing a second magnetic field. The second oscillating signal has a second parameter which is a function of disturbances in the second magnetic field when the coin to be evaluated is located within the second magnetic field. The parameters are converted to digital signals and provided to a computer which indicates the acceptability and denomination of the coin when a ratio or other arithmetic relationship of the first and second parameters is within an acceptable range.

29 Claims, 3 Drawing Sheets

U.S. PATENT DOCUMENTS

| | | | |
|---|---|---|---|
| 3,966,034 | 6/1976 | Heiman et al. . | |
| 3,980,168 | 9/1976 | Knight et al. . | |
| 3,998,309 | 12/1976 | Mandas et al. . | |
| 4,089,400 | 5/1978 | Gregory, Jr. . | |
| 4,091,908 | 5/1978 | Hayashi et al. . | |
| 4,105,105 | 8/1978 | Braum . | |
| 4,106,610 | 8/1978 | Heiman . | |
| 4,108,296 | 8/1978 | Hayashi et al. . | |
| 4,124,110 | 11/1978 | Hovorka . | |
| 4,124,111 | 11/1978 | Hayashi . | |
| 4,128,157 | 12/1978 | Henville . | |
| 4,128,158 | 12/1978 | Dautremont, Jr. . | |
| 4,151,904 | 5/1979 | Levasseur et al. . | |
| 4,172,222 | 10/1979 | Eglise | 250/223 |
| 4,228,811 | 10/1980 | Tanaka et al. . | |
| 4,234,071 | 11/1980 | Le-Hong . | |
| 4,254,857 | 3/1981 | Levasseur et al. . | |
| 4,257,512 | 3/1981 | Hooker . | |
| 4,267,916 | 5/1981 | Black et al. . | |
| 4,286,704 | 9/1981 | Wood . | |
| 4,323,148 | 4/1982 | Nichimoto et al. . | |
| 4,326,621 | 4/1982 | Davies . | |
| 4,333,557 | 6/1982 | Kozak . | |
| 4,334,604 | 6/1982 | Davies . | |
| 4,353,452 | 10/1982 | Shah et al. . | |
| 4,353,453 | 10/1982 | Partin et al. . | |
| 4,354,587 | 10/1982 | Davies . | |
| 4,359,148 | 11/1982 | Davies . | |
| 4,371,073 | 2/1983 | Dubey . | |
| 4,398,626 | 8/1983 | Barnes . | |
| 4,416,365 | 11/1983 | Heiman . | |
| 4,431,014 | 2/1984 | Yokomori . | |
| 4,441,602 | 4/1984 | Ostroski et al. . | |
| 4,448,297 | 5/1984 | Mendelsohn . | |
| 4,460,003 | 7/1984 | Barnes et al. . | |
| 4,460,080 | 7/1984 | Howard . | |
| 4,462,513 | 7/1984 | Dean et al. . | |
| 4,488,116 | 12/1984 | Plesko | 324/236 |
| 4,492,296 | 1/1985 | Dubey . | |
| 4,493,411 | 1/1985 | Heiman . | |
| 4,538,719 | 9/1985 | Gray et al. . | |
| 4,556,140 | 12/1985 | Okada . | |
| 4,572,349 | 2/1986 | Furuya et al. | 194/318 |
| 4,574,935 | 3/1986 | Partridge | 194/319 |
| 4,574,936 | 3/1986 | Klinger | 194/318 |
| 4,582,189 | 4/1986 | Schmitt | 194/317 |
| 4,601,380 | 7/1986 | Dean et al. | 194/318 |
| 4,625,851 | 12/1986 | Johnson et al. | 194/200 |
| 4,625,852 | 12/1986 | Hoormann | 194/317 |
| 4,646,904 | 3/1987 | Hoormann | 194/334 |
| 4,660,705 | 4/1987 | Kai et al. | 194/318 |
| 4,664,244 | 5/1987 | Wright | 194/317 |
| 4,674,618 | 6/1987 | Eglise et al. | 194/210 |
| 4,705,154 | 11/1987 | Masho et al. | 194/100 |
| 4,717,006 | 1/1988 | Chapman et al. | 194/318 |
| 4,749,087 | 6/1988 | Buttifant | 209/534 |

COIN VALIDATING APPARATUS AND METHOD

FIELD OF THE INVENTION

The invention relates generally to a method and apparatus for validating and selecting a coin and, in particular, to an apparatus for evaluating a conductive coin to verify its authenticity and to determine its denomination by evaluating disturbances caused by the coin in magnetic fields.

BACKGROUND OF THE INVENTION

Coin validators of the prior art use mechanical, electromechanical or electrical techniques for verifying the authenticity of a coin and to assist in determining the denomination of a coin. The electrical techniques generally take the form of generating one or more magnetic fields through which the coin to be evaluated passes as it proceeds down the coin path. The disturbances in the magnetic fields caused by the coin as the coin traverses each field are evaluated.

For example, an oscillating circuit to generate the magnetic field by applying an oscillating signal to a coil can be employed. The coil as energized by the circuit is tuned to generate a magnetic field which, when a valid coin passes through it, results in significant attenuation of the amplitude of the oscillating signal. This attenuated amplitude is an indication of the authenticity of the coin and permits verification and acceptance of the coin. The coin may then be sorted according to size and therefore by denomination by either a mechanical, electrical or electromechanical sorter.

More recently, it has been proposed that a computer may be used to evaluate the tuned oscillating signals of a coil energized by an oscillating circuit to determine the authenticity and/or denomination of a coin. In general, a parameter of the oscillating signal is compared to a reference range. If the computer determines that the parameter falls within the reference range, the computer indicates that the coin is authentic and verifies it. While this system provides the ability to program the computer for various types of coins, it is not extremely accurate. First of all, such a system tends to be temperature sensitive and at extreme low or high temperatures the parameters of a valid coin may fall outside the reference range so that the system may operate inaccurately. Furthermore, it becomes difficult for the computer to distinguish between coins of similar size or mass.

SUMMARY OF THE INVENTION

It is an object of this invention to provide a coin validating apparatus and method which is accurate and can distinguish between coins of similar size and mass.

It is another object of this invention to provide a coin validating apparatus and method which compensates for temperature changes and can accurately verify a coin over a wide temperature range.

It is another object of this invention to provide a coin validating apparatus and method which can be programmed to accurately verify and determine the denomination of coins in various coin sets.

Other objects and features will be in part apparent and in part pointed out hereinafter.

The apparatus of the invention evaluates a conductive coin to verify its authenticity and to determine its denomination. First means generates a first signal parameter which is a function of a first magnetic field when the coin is located within the first magnetic field.

Second means generates a second signal parameter which is a function of a second magnetic field when the coin is located within the second magnetic field. Means indicates the acceptability and denomination of the coin when an arithmetic relationship between the first and second signal parameters is within a predetermined range. The apparatus may include third means for generating a third signal parameter which is a function of the third magnetic field when the coin is located within the third magnetic field in which case the acceptability means indicates the acceptability and denomination of the coin when an arithmetic relationship between the at least two of the first, second and third parameters is within a predetermined range.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
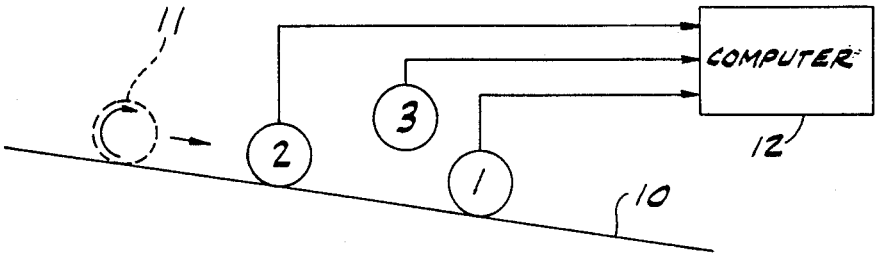
FIG. 1 is a diagrammatic view of three coils positioned along a coin guide path.

In any type of dispensing device, such as a food drink, token or change vending machine, a coin validating apparatus may be used to verify the authenticity of coins and to determine their denomination. As used herein, coin means any genuine or nongenuine coin or other item which may be placed in a dispensing device which is coin operated. After the coin is placed in a device, it travels along a guided coin path to the coin validating apparatus. As shown in FIG. 1, the coin validating apparatus of the invention may be three coils energized to provide magnetic fields across guided coin path 10. As coin 11 traverses the coin path 10, it first encounters the magnetic field generated by coil 2. Next it encounters the magnetic field of coil 3 and finally it encounters the magnetic field of coil 1. If the interaction between the coin 11 and the magnetic fields is within acceptable limits, computer 12 verifies the authenticity and/or denomination of the coin and the coin is thus accepted. Otherwise, the coin is rejected.

In particular, each of the coils 1,2,3 is part of a means for generating a signal parameter which is a function of a magnetic field when the coin is located within the magnetic field. The three signal parameters are provided to a means for indicating the acceptability and denomination of the coin. Such means may be computer 12 in which case each one of the signal parameters may be converted into a digital signal. The computer is programmed to determine an arithmetic relationship, such as particular ratios between the signal parameters. After determining these ratios, the computer compares the ratios to a predetermined range. When the ratios fall within the predetermined range, the authenticity of the coin is verified and the denomination may be determined, depending on the particular range within which the ratios fall. In general, each denomination of coin generates a set of signal parameter ratios which falls within a unique range. These ranges can be predetermined and stored in memory. Authenticity and denomination can be determined by a minimum of one coil used to generate two signal parameters, such as amplitude and phase, to form a ratio which can be compared to the predetermined range. However, it is preferable to employ three coils providing five signal parameters as illustrated in FIG. 2.

Figure 2:
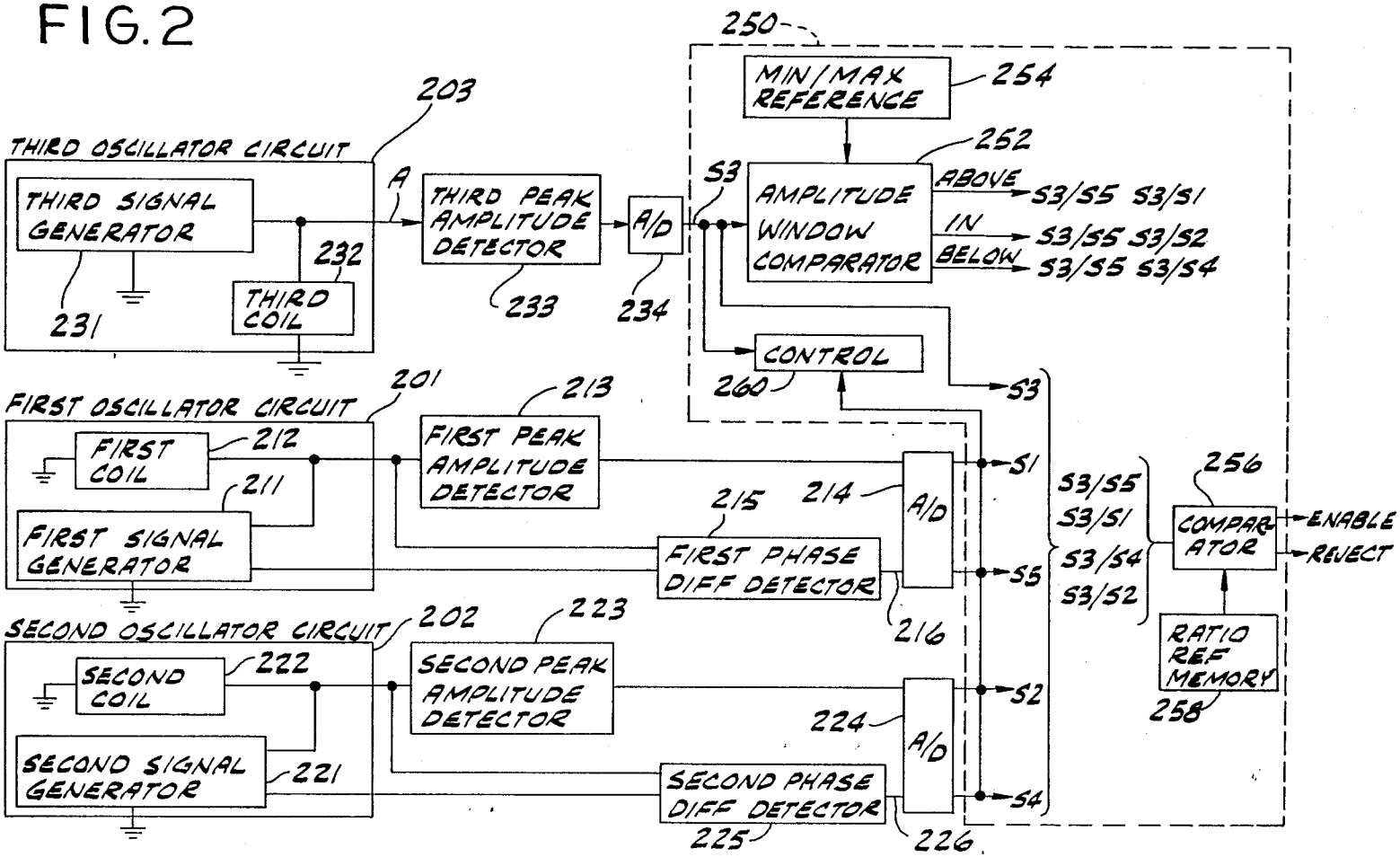
FIG. 2 is a block diagram of a coin validating apparatus according to the invention including three oscillator circuits.

Referring to FIG. 2, first oscillator circuit 201, second oscillator circuit 202 and third oscillator circuit 203 each comprise means for generating an oscillating signal having a parameter which is a function of the magnetic field produced by the oscillating signal when the coin being verified is located within the magnetic field. In particular, first oscillator circuit 201 includes a first signal generator 211, such as a tank circuit oscillating at 16 KHz to provide properly phased feedback, for generating a first oscillating signal which is applied to first coil 212. Coil 212 is energized to generate a first magnetic field in response to the first oscillating signal. The first oscillating signal has several parameters, such as phase, amplitude and frequency, each of which may be modified as a function of disturbances in the first magnetic field caused by the coin being evaluated when the coin is located within the first magnetic field. A selected parameter, such as first parameter S1, has a value (magnitude) which corresponds to the amplitude of the first oscillating signal as detected by first peak amplitude (envelope detector 213 and converted into a digital signal by analog-to-digital converter 214.

Similarly, second oscillator circuit 202 includes second signal generator 221, such as a tank circuit oscillating at 16 KHz, supplying a second oscillating signal to second coil 222. Coil 222 is energized to generate a second magnetic field in response to the second oscillating signal. A selected parameter of this signal, i.e., second parameter S2, is modified as a function of disturbances in the second magnetic field caused by the coin being evaluated when the coin is located within the second magnetic field. Second parameter S2 is detected by second peak amplitude (envelope) detector 223 and converted into a digital signal by analog-to-digital converter 224.

Similarly, third oscillator circuit 203 includes third signal generator 231, such as a modified Colpitts oscillator oscillating at 500 KHz, supplying a third oscillating signal to third coil 232 for generating a third magnetic field. Coil 232 is energized to generate a third magnetic field in response to the third oscillating signal. A selected parameter of this signal, i.e., third parameter S3, is modified as a function of disturbances in the third magnetic field caused by the coin being evaluated when the coin is located within the third magnetic field. Third parameter S3 is detected by third peak amplitude envelope) detector 233 and converted into a digital signal by analog-to-digital converter 234.

More than one parameter of an oscillating signal may be detected. As shown in FIG. 2, the first oscillating signal generated by first signal generator 211 may include signal parameter S5 which corresponds to a change in the phase difference detected by first phase difference detector 215. Detector 215 compares the phase of the first oscillating signal provided by generator 211 to the phase of the modified first oscillating signal provided by first coil 212 to provide a signal via line 216 representing the phase difference change. This signal is converted to a first digital phase difference signal by A/D converter 214. Similarly, the second oscillating signal generated by second signal generator 221 may include parameter S4 which corresponds to a change in the phase difference detected by second phase difference detector 225. Detector 225 compares the phase of the second oscillating signal provided by generator 221 to the phase of the modified second oscillating signal provided by second coil 222 to provide a signal via line 226 representing the phase difference change. This signal is converted into a second digital phase difference signal by A/D converter 224.

Computer 250 determines the acceptability and denomination of the coin based on its evaluation of an arithmetic relationship between any two or more of the selected parameters. Computer 250 determines the relationships and compares them to ranges corresponding to valid coins. In the preferred embodiment as illustrated in FIG. 2, the particular arithmetic relationships are specified according to the range of parameter S3 Amplitude window comparator 252 compares the magnitude of S3 to a minimum reference and a maximum reference stored in memory 254. These references define a min/max range to which parameter S3 is compared to initially determine the ratios to be evaluated. If the value of S3 is above the range, this indicates that the coin being examined has the characteristics of a nickel coin in which case computer 250 determines ratios S3/S5 and S3/S1. If the value of parameter S3 is within the min/max range, this indicates that the coin has the characteristics of a quarter and the computer determines ratios S3/S5 and S3/S2. In the event that the value of S3 is below the min/max range, a coin has the characteristics of a dime and computer 250 determines ratios S3/S5 and S3/S4. Computer 250 includes comparator 256 which compares each of the determined ratios to ratios stored in ratio reference memory 258. If the determined ratios are within one of the predetermined ranges stored in memory 258 which correspond to valid coins, computer 250 provides an enable signal verifying the authenticity and denomination of the coin based on the particular range within which the ratios fall. Conversely, if the determined ratios do not fall within one of the predetermined ranges stored in ratio reference memory 258, computer 250 provides a reject signal indicating that it is unable to verify the authenticity of the coin.

The arithmetic relationship which computer 250 uses to verify the authenticity of a coin being examined may be any formula, equation or other mathematical relationship between the available parameters which provides a value to be compared to the value stored in ratio reference memory 258. In the preferred embodiment, the arithmetic relationship is particular ratios of particular parameters depending upon the value of parameter S3. For example, certain parameter ratios are insensitive to temperature variations and may be used in validators which are subjected to wide temperature ranges. Also certain parameter ratios may be more sensitive to physical coin features such as size, shape or embossing and may be used to increase the accuracy of distinguishing between different coins of having similar physical characteristics. Preferably, parameter S3 is used as the numerator for each of the ratios. Any of the ratios may be inverted depending on range of the parameters forming the ratio and the amount of memory available.

In general, the arithmetic relationship may be a sum, difference or polynomial relationship between any two or more of the available parameters. For example, if four parameters are available, the arithmetic relationship may be a ratio of the first and second parameters when the third parameter is below a given range; or a ratio of the second and fourth parameters when the third parameter is within the given range; or a ratio of the first and fourth parameters when the third parameter is above the given range.

Alternatively, if four parameters are available, the arithmetic relationship may be a ratio of the third and first parameters when the third parameter is below a given range; or a ratio of the third and second parameters when the third parameter is within the given range; or a ratio of the third and fourth parameters when the third parameter is above the given range.

As shown in FIG. 2, where five parameters (S1,S2,S3,S4,S5) are available, the arithmetic relationship comprises a ratio of the third and fifth parameters and a ratio of the first and third parameters when the third parameter is below a given range; or a ratio of the third and fifth parameters and a ratio of the second and third parameters when the fifth parameter is within the given range; or a ratio of the third and fifth parameters and a ratio of the third and fourth parameters when the third parameter is above the given range.

Figure 3A:
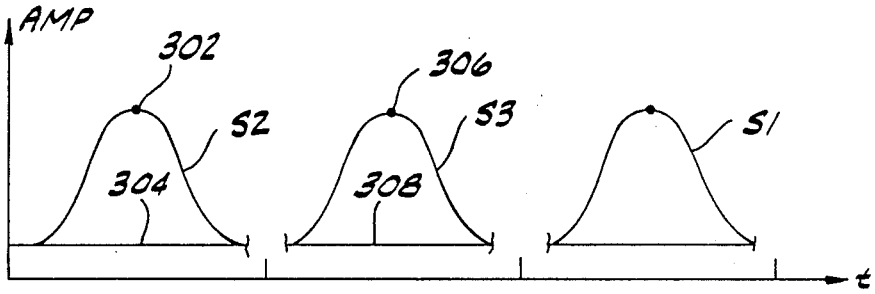
FIGS. 3A and 3B are graphs of amplitude and phase differences, respectively, of the signals generated by the apparatus of FIG. 2 as a coin passes the coils.
Figure 3B:
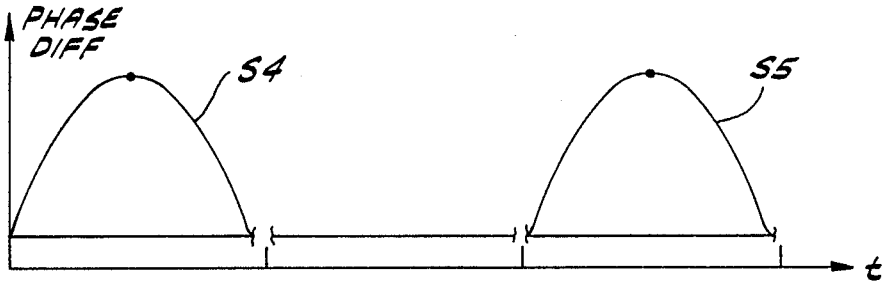

FIGS. 3A and 3B are graphs illustrating the values of the parameters. Absolute values of amplitude and phase difference are graphed along the ordinate and time is graphed along the abscissa. The graphs are not to scale. Parameters S1, S2 and S3 represent amplitude and are shown as part of FIG. 3A whereas parameters S4 and S5 represent phase difference and are shown as part of FIG. 3B. First, the coin encounters the second magnetic field generated by the second coil cause a decrease (attenuation) in the amplitude and change in the phase difference of the modified second oscillating signal as compared to the unmodified second oscillating signal. The decrease in amplitude corresponds to the magnitude of parameter S2 whereas the phase difference caused by the coin corresponds to the value of parameter S4. The amplitude is detected by second peak amplitude detector 223 which may be an operational amplifier providing a positive (or inverted attenuated signal) output signal. The amplitude reaches a peak value 302 when the coin is opposite coil 2 and then tapers back down to the reference oscillating value 304 after the coin passes coil 2. Value 304 corresponds to the amplitude of the second oscillating signal without modification due to disturbances the coin causes in the second magnetic field. As the coin travels down guided coin path 10, it next encounters the third magnetic field generated by the third coil. The third signal generator and third coil are tuned such that an authentic coin will modify the third oscillating signal by causing attenuation in the amplitude of the third oscillating signal. This amplitude is detected by another, the third, peak amplitude detector 233. The detected amplitude reaches a peak value 306 when the coin is opposite coil 3 and then tapers back down to the reference oscillating value 308 after the coin passes coil 3. Value 308 corresponds to the amplitude of the third oscillating signal without modification due to the disturbances the coin causes in the third magnetic field. Finally, the coin passes coil 1 and through the first magnetic field to generate amplitude parameter S1 and phase parameter S5 in the same manner that parameters S2 and S4 are generated.

Computer 250 may also include control 260 which monitors the value of each of the parameters. An increase in one or more of the parameters will activate computer 250 thereby indicating that a coin has entered one of the magnetic fields and indicating that the process of authentication and determination of the denomination of the coin should begin.

Figure 4:
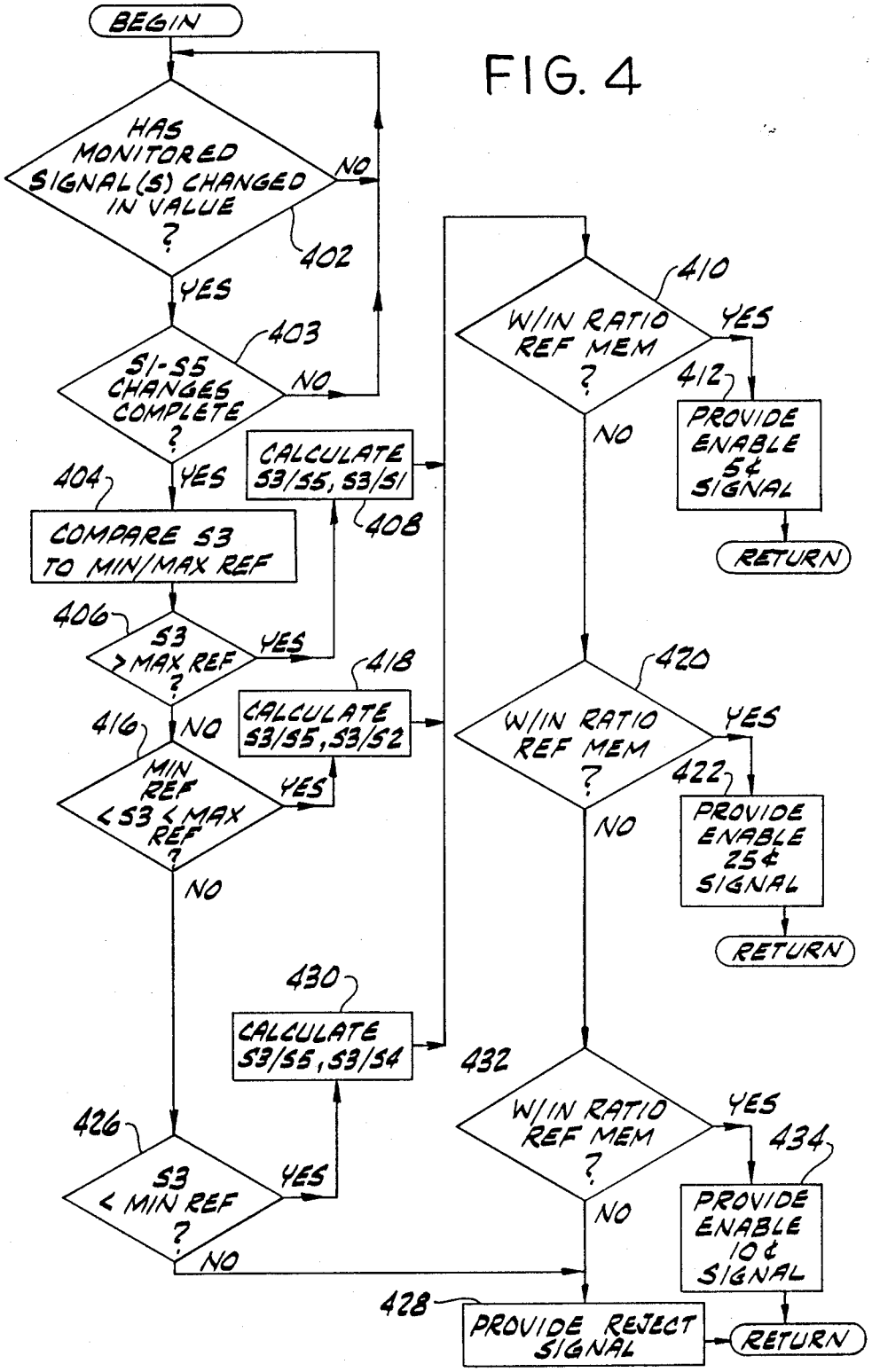
FIG. 4 is a flow chart of the steps of the coin validating method according to the invention and illustrating the steps performed by the computer of FIG. 2.

FIG. 4 illustrates a flow chart of the process performed by the operation of computer 250 according to the invention. At step 402, the control 260 of computer 250 monitors the signal parameters to determine whether any of the parameters have changed in value. Upon an indication of a value change, the computer 250 proceeds to step 403 to wait for the value of all five parameters to change, and then to step 404 where the computer compares the peak value of parameter S3 detected by detector 233 and converted to a digital signal to the minimum/maximum reference values which define a range stored in memory 254. Computer 250 then begins to evaluate the comparison.

First, computer 250 proceeds to step 406 to determine whether the peak value of third signal parameter S3 is greater than the maximum reference stored in memory 254. If it is, the computer proceeds to step 408 to calculate ratio S3/S5 and ratio S3/S1. The series of steps beginning with step 410 is then executed. The calculated ratios are compared by step 410 with the ratios stored in reference memory 258 which correspond to valid nickels. If the ratios are within the ratios corresponding to a nickel which are stored in the reference memory, computer 250 proceeds to step 412 to provide an enable signal indicating that a nickel has been authenticated. If the calculated ratios are not within the range of nickel ratios stored in reference memory 258, computer 250 proceeds to step 420 where the calculated ratios are compared to the quarter ratios stored in the reference memory 258. If the calculated ratios are within range of quarter ratios, a quarter enable signal is provided by step 422. Otherwise, computer 250 proceeds to step 432 where the calculated ratios are compared to dime ratios. If the calculated ratios are within range of dime ratios, a dime enable signal is provided by step 434. Otherwise, computer 250 proceeds to step 428 to provide a reject signal indicating that the coin could not be verified and is unacceptable.

If the peak value of third signal parameter S3 is not greater than the maximum reference stored in memory 254, computer 250 proceeds from step 406 to step 416. At step 416, computer 250 determines whether the peak value of third parameter S3 is within the range stored in reference memory 254. If it is, computer 250 proceeds to step 418 to calculate ratio S3/S5 and to calculate ratio S3/S2. The series of steps beginning with step 410 is then executed. If the calculated ratios are within the range of ratios stored in reference memory 258 for nickels, quarters or dimes as determined by steps 410, 420 or 432, computer 250 proceeds to step 412, 422 or 434 to provide an enable signal indicating that an authentic has been verified, respectively. Otherwise,if the calculated ratios are not within the stored ranges, the computer proceeds to step 428 to provide a reject signal indicating that the coin being evaluated could not be verified and is unacceptable.

If the peak value of third parameter S3 is not greater than or within the range stored in reference memory 254, computer 250 proceeds from step 416 to step 426 to verify that the peak value of S3 is less than the minimum reference stored in memory 254. If it is not, then a detecting error has probably occurred and computer 250 proceeds to step 428 providing a reject signal. If the peak value of S3 is less than the reference range, computer 250 proceeds to step 430 to calculate ratio S3/S5 and ratio S3/S4. The series of steps beginning with step 410 is then executed. If the calculated ratios are within the range of ratios stored in reference memory 258 for nickels, quarters or dimes as determined by steps 410, 420 or 432, computer 250 proceeds to step 412, 422 or 434 to provide an enable signal indicating that an authentic has been verified, respectively. Otherwise, if the calculated ratios are not within the stored range, computer 250 proceeds to step 428 to provide a reject signal indicating that the coin being evaluated could not be verified and is unacceptable.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for evaluating a conductive coin to verify its authenticity and to determine its denomination comprising:

first means for generating a first signal parameter which is a function of a first magnetic field when the coin is located within the first magnetic field;

second means for generating a second signal parameter which is a function of a second magnetic field when the coin is located within the second magnetic field;

means for determining an arithmetic relationship between the first and second signal parameters;

means for comparing the arithmetic relationship to a predetermined range; and means, responsive to the comparing means, for indicating the acceptability and denomination of the coin when the arithmetic relationship between the first and second signal parameters is within the predetermined range.

2. The apparatus of claim 1 further comprising:

means for generating a third signal parameter which is a function of a third magnetic field when the coin is located within the third magnetic field;

wherein the arithmetic relationship determined by the determining means is a relationship between the first, second, and third signal parameters; and wherein the indicating means indicates the acceptability and denomination of the coin when the arithmetic relationship between the first, second and third signal parameters is within the predetermined range.

3. The apparatus of claim 1 wherein:

said first means comprises means for generating a first oscillating signal having a first parameter which is a function of the first magnetic field when the coin is located within the first magnetic field;

said second means comprises means for generating a second oscillating signal having a second parameter which is a function of the second magnetic field when the coin is located within the second magnetic field;

wherein the determining means determines an arithmetic relationship between the first and second parameters; and wherein the indicating means indicates the acceptability and denomination of the coin when the arithmetic relationship between the first and second parameters is within the predetermined range.

4. The apparatus of claim 3 wherein:

said first signal generating means comprises means for producing a first magnetic field in response to the first oscillating signal, the first oscillating signal having a first parameter which is a function of disturbances in the first magnetic field when the coin is located within the first magnetic field; and said second signal generating means comprises means for producing a second magnetic field in response to the second oscillating signal, the second oscillating signal having a second parameter which is a function of disturbances in the second magnetic field when the coin is located within the second magnetic field.

5. The apparatus of claim 4 wherein said first signal generating means comprises a first oscillator circuit, said first magnetic field producing means comprises a first coil energized by the first oscillator circuit, said second signal generating means comprises a second oscillator circuit, said second magnetic field producing means comprises a second coil energized by the second oscillator circuit, and wherein the arithmetic relationship comprises a ratio of the first and second parameters.

6. The apparatus of claim 5 further comprising a first detector adapted to detect the first parameter from the first oscillating signal energizing the first coil, a second detector adapted to detect the second parameter from the second oscillating signal energizing the second coil, and means for converting the first and second parameters into corresponding first and second digital parameters, respectively, and wherein said indicating means comprises a computer adapted to determine the ratio and to compare the determined ratio to a range stored in memory.

7. The apparatus of claim 4 further comprising:

means for generating a third oscillating signal;

means for producing a third magnetic field in response to the third oscillating signal, the third oscillating signal having a third parameter which is a function of disturbances in the third magnetic field when the coin is located within the third magnetic field;

wherein the arithmetic relationship determined by the determining means is a relationship between the first, second, and third parameters; and wherein the comparing means compares the arithmetic relationship to an acceptable range; and wherein said indicating means indicates the acceptability and denomination of the coin when the arithmetic relationship between the first, second and third parameters is within the acceptable range.

8. The apparatus of claim 7 wherein the determining means determines a first ratio of the first parameter to the second parameter and determines a second ratio of the first parameter to the third parameter, wherein the comparing means compares the first and second ratios to first and second acceptable ranges, respectively, and wherein said indicating means indicates the acceptability and denomination of the coin when the first ratio is within the first acceptable range and when the second ratio is within the second acceptable range.

9. The apparatus of claim 7 wherein the determining means determines a first ratio of the first parameter to the second parameter and determines a second ratio of the first parameter to the third parameter, wherein the comparing means compares the first and second ratios to first and second acceptable ranges, respectively, and wherein said indicating means indicates the acceptability and denomination of the coin when the first ratio is within the first acceptable range and when the second ratio is within the second acceptable range.

10. The apparatus of claim 7 wherein the determining means determines a first ratio of the first parameter to the second parameter and determines a second ratio of the first parameter to the third parameter, wherein the comparing means compares the first and second ratios to first and second acceptable ranges, respectively, and wherein said indicating means indicates the acceptability and denomination of the coin when the first ratio is within the first acceptable range and when the second ratio is within the second acceptable range.

11. The apparatus of claim 7 further comprising:

means for generating a fourth signal parameter which is a function of disturbances in the second magnetic field when the coin is located within the second magnetic field;

wherein the arithmetic relationship determined by the determining means is a relationship between the first, second, third, and fourth parameters; and wherein said indicating means indicates the acceptability and denomination of the coin when the arithmetic relationship between the first, second, third and fourth parameters is within the acceptable range.

12. The apparatus of claim 11 further comprising:

means for generating a fifth signal parameter which is a function of disturbances in the first magnetic field when the coin is located within the first magnetic field;

wherein the arithmetic relationship determined by the determining means is a relationship between the first, second, third, fourth, and fifth parameters; and wherein said indicating means indicates the acceptability and denomination of the coin when the arithmetic relationship between the first, second, third and fourth parameters is within an acceptable range which is a function of the fifth parameter.

13. The apparatus of claim 12 wherein the first parameter is an amplitude of the first oscillating signal and the fifth parameter is a phase of the first oscillating signal, and wherein the third parameter is an amplitude of the third oscillating signal and the fourth parameter is a phase of the second oscillating signal.

14. Apparatus for evaluating a conductive coin to verify its authenticity and to determine its denomination comprising:

first means for generating a first signal parameter which is a function of a first magnetic field when the coin is located within the first magnetic field;

second means for generating a second signal parameter which is a function of a second magnetic field when the coin is located within the second magnetic field;

third means for generating a third signal parameter which is a function of a third magnetic field when the coin is located within the third magnetic field;

means for determining an arithmetic relationship between at least two of the first, second and third signal parameters;

means for comparing the arithmetic relationship to a predetermined range; and means, responsive to the comparing means, for indicating the acceptability and denomination of the coin when the arithmetic relationship between a least two of the first, second and third signal parameters is within the predetermined range.

15. The apparatus of claim 14 wherein:

said first means comprises means for generating a first oscillating signal having a first parameter which is a function of the first magnetic field when the coin is located within the first magnetic field;

said second means comprises means for generating a second oscillating signal having a second parameter which is a function of the second magnetic field when the coin is located within the second magnetic field;

said third means comprises means for generating a third oscillating signal having a third parameter which is a function of the third magnetic field when the coin is located within the third magnetic field;

wherein the arithmetic relationship determined by the determining means is a relationship between a least two of the first, second and third parameters and wherein said means for indicating indicates the acceptability and denomination of the coin when the arithmetic relationship between at least two of the first, second and third parameters is within the predetermined range.

16. The apparatus of claim 14 wherein:

said first signal generating means comprises means for producing the first magnetic field in response to the first oscillating signal, the first parameter being a function of disturbances in the first magnetic field when the coin is located within the first magnetic field;

said second signal generating means comprises means for producing the second magnetic field in response to the second oscillating signal, the second parameter being a function of disturbances in the second magnetic field when the coin is located within the second magnetic field; and said third signal generating means comprises means for producing the third magnetic field in response to the third oscillating signal, the third parameter being a function of disturbances in the third magnetic field when the coin is located within the third magnetic field.

17. The apparatus of claim 16 further comprising:

means for generating a fourth signal parameter which is a function of disturbances in the second magnetic field when the coin is located within the second magnetic field;

wherein the arithmetic relationship determined by the determining means is a relationship between a least two of the first, second, third and fourth parameters; and wherein said indicating means indicates the acceptability and denomination of the coin when the arithmetic relationship between at least two of the first, second, third and fourth parameters is within an acceptable range which is a function of the third parameter.

18. The apparatus of claim 17 wherein the arithmetic relationship comprises a ratio of the first and second parameters when the third parameter is below a given range, wherein the arithmetic relationship comprises a ratio of the second and fourth parameters when the third parameter is within the given range, and wherein the arithmetic relationship comprises a ratio of the first and fourth parameters when the third parameter is above the given range.

19. The apparatus of claim 17 wherein the arithmetic relationship comprises a ratio of the third and first parameters when the third parameter is below a given range, wherein the arithmetic relationship comprises a ratio of the third and second parameters when the third parameter is within the given range, and wherein the arithmetic relationship comprises a ratio of the third and fourth parameters when the third parameter is above the given range.

20. The apparatus of claim 17 further comprising:

means for generating a fifth signal parameter which is a function of disturbances in the first magnetic field when the coin is located within the first magnetic field;

wherein the arithmetic relationship determined by the determining means is a relationship between at least two of the first, second, third, fourth and fifth parameters; and wherein said indicating means indicates the acceptability and denomination of the coin when the arithmetic relationship between at least two of the first, second, third, fourth and fifth parameters is within the acceptable range which is a function of the third parameter.

21. The apparatus of claim 20 wherein the first parameter is an amplitude of the first oscillating signal and the fifth parameter is a phase of the first oscillating signal, and wherein the second parameter is an amplitude of the second oscillating signal and the fourth parameter is a phase of the second oscillating signal.

22. The apparatus of claim 20 wherein the first parameter is amplitude of the first oscillating signal, the second parameter is amplitude of the second oscillating signal, the third parameter is amplitude of the third oscillating signal, the second oscillating signal has a phase which is a fourth parameter, the first oscillating signal has a phase which is a fifth parameter, and said indicating means indicates acceptability and denomination when an arithmetic relationship between at least two of the first, second, third, fourth and fifth parameters is within an acceptable range which is a function of the third parameter.

23. The apparatus of claim 22 wherein the arithmetic relationship comprises a ratio of the third and fifth parameters and a ratio of the first and third parameters when the third parameter is below a given range, wherein the arithmetic relationship comprises a ratio of the third and fifth parameters and a ratio of the second and third parameters when the third parameter is within the given range, and wherein the arithmetic relationship comprises a ratio of the third and fifth parameters and a ratio of the third and fourth parameters when the third parameter is above the given range.

24. The apparatus of claim 16 wherein said first signal generating means comprises a first oscillator circuit, said first magnetic field producing means comprises a first coil, said second signal generating means comprises a second oscillator circuit, said second magnetic field producing means comprises a second coil, said third signal generating means comprises a third oscillating circuit, said third magnetic field producing means comprises a third coil, and wherein the arithmetic relationship comprises a ratio of at least two of the first, second and third parameters.

25. The apparatus of claim 24 further comprising a first detector adapted to detect the first parameter from the first oscillating signal energizing the first coil, a second detector adapted to detect the second parameter from the second oscillating signal energizing the second coil, and means for converting the first, second and third parameters into corresponding first, second and third digital parameters, respectively, and wherein said indicating means comprises a computer adapted to determine the ratio and to compare the determined ratio to a range stored in memory.

26. Apparatus for evaluating a conductive coin to verify its authenticity and to determine its denomination comprising:

a first oscillator circuit generating a first oscillating signal;

a first coil energized by first oscillating signal to produce a first magnetic field, the first oscillating signal having a first parameter which is a function of disturbances in the first magnetic field when the coin is located within the first magnetic field;

a second oscillator circuit generating a second oscillating signal;

a second coil energized by second oscillating signal to produce a second magnetic field, the second oscillating signal having a second parameter which is a function of disturbances in the second magnetic field when the coin is located within the second magnetic field;

means for determining an arithmetic relationship of the first and second parameters;

means for comparing the arithmetic relationship to an acceptable range; and means, responsive to the comparing means, for indicating the acceptability and denomination of the coin when the arithmetic relationship of the first and second parameters is within the acceptable range.

27. Method for evaluating a conductive coin to verify its authenticity and to determine its denomination comprising the steps of:

generating a first signal parameter which is a function of a first magnetic field when the coin is located within the first magnetic field;

generating a second signal parameter which is a function of a second magnetic field when the coin is located within the second magnetic field;

determining an arithmetic relationship between the first and second signal parameters;

comparing the arithmetic relationship to a predetermined range; and indicating the acceptability and denomination of the coin when the arithmetic relationship between the first and second signal parameters is within the predetermined range.

28. Method for evaluating a conductive coin to verify its authenticity and to determine its denomination comprising the steps of:

generating a first signal parameter which is a function of a first magnetic field when the coin is located within the first magnetic field;

generating a second signal parameter which is a function of a second magnetic field when the coin is located within the second magnetic field;

determining an arithmetic relationship between at least two of the first, second and third signal parameters;

comparing the arithmetic relationship to a predetermined range; and indicating the acceptability and denomination of the coin when the arithmetic relationship between at least two of the first, second and third signal parameters is within the predetermined range.

29. Apparatus for evaluating a conductive coin to verify its authenticity and to determine its denomination comprising:

means for generating a magnetic field through which the coin passes;

means for detecting the amplitude of the magnetic field when the coin is located within the magnetic field;

means for detecting the phase of the magnetic field when the coin is located within the magnetic field;

means for determining an arithmetic relationship between the amplitude and the phase;

means for comparing the arithmetic relationship to a predetermined range; and means, responsive to the comparing means, for indicating the acceptability and denomination of the coin when the arithmetic relationship between the amplitude and the phase is within the predetermined range.

* * * * *